US005943874A

United States Patent [19]

Maeda

[11] Patent Number: 5,943,874

[45] **Date of Patent: *Aug. 31, 1999**

[54] DESICCANT ASSISTED AIR CONDITIONING APPARATUS

[75] Inventor: Kensaku Maeda, Fujisawa, Japan

[73] Assignee: Ebara Corporation, Tokyo, Japan

[ * ] Notice: This patent is subject to a terminal disclaimer.

[21] Appl. No.: 08/935,260

[22] Filed: Sep. 22, 1997

[30] Foreign Application Priority Data

Sep. 24, 1996 [JP] Japan ..... 8-272986

[51] Int. Cl.[6] ..... F25D 23/00; F25B 15/00

[52] U.S. Cl. ..... 62/271; 62/238.3; 62/486

[58] Field of Search ..... 62/101, 476, 485, 62/486, 489, 271, 93, 94, 185, 324.2, 238.3

[56] References Cited

U.S. PATENT DOCUMENTS

| | | | |
|---|---|---|---|
| 2,535,776 | 12/1950 | Berestneff | 62/486 |
| 4,667,485 | 5/1987 | Ball et al. | 62/476 |
| 4,819,444 | 4/1989 | Meckler | 62/238.6 |
| 4,887,438 | 12/1989 | Meckler . | |
| 4,903,503 | 2/1990 | Meckler | 62/238.3 |
| 4,905,479 | 3/1990 | Wilkinson | 62/271 |
| 4,966,007 | 10/1990 | Osborne | 62/101 |
| 5,218,844 | 6/1993 | Nishiguchi et al. | 62/476 |
| 5,303,565 | 4/1994 | Pravda | 62/476 |
| 5,325,676 | 7/1994 | Meckler | 62/93 |
| 5,448,895 | 9/1995 | Coellner et al. | 62/94 |
| 5,718,122 | 2/1998 | Maeda | 62/185 |
| 5,732,562 | 3/1998 | Moratalla | 62/94 |

*Primary Examiner*—William Doerrler

*Attorney, Agent, or Firm*—Armstrong, Westerman, Hattori McLeland & Naughton

[57] ABSTRACT

The desiccant assisted air conditioning apparatus can provide a stable operation and a higher energy efficiency. The apparatus comprises a process air passage for flowing process air for dehumidification through a desiccant and for delivery to a conditioning space and a regeneration air passage for flowing regeneration air for removing moisture from the desiccant. An absorption heat pump means for providing cooling heat source for the process air and heating heat source for the regeneration air is provided which comprises an evaporator, an absorber, a generator, a condenser and fluid passages therebetween for forming an absorption refrigeration cycle. The absorption heat pump means is provided with a heat exchanger in a refrigerant passage between the condenser and the evaporator for cooling a refrigerant flowing through the refrigerant passage by heat exchange with a heat transfer medium.

8 Claims, 9 Drawing Sheets

DESICCANT ASSISTED AIR CONDITIONING APPARATUS

BACKGROUND OF THE INVENTION

1. Field of the Invention

The present invention relates to a desiccant assisted air conditioning apparatus utilizing a heat pump device for desiccant regeneration and cooling of process air.

2. Description of the Related Art

Desiccant assisted air conditioning apparatus is well known, for example in a U.S. Pat. No. 2,700,537. The reference discloses a desiccant assisted air conditioning apparatus requiring a heat source of a temperature range of 100–150° C. for regenerating the desiccant (moisture adsorbent), such as electric heaters or boilers. In recent years, desiccants which can be regenerated at lower temperatures in a range of 60–80° C. have been developed so that heat sources operating at lower temperatures can be utilized.

FIG. 6 is a schematic representation of a typical example of such improved desiccant assisted apparatus, and FIG. 7 is a psychrometric chart showing the operation of this example apparatus. In FIG. 6, the reference numeral 101 refers to a conditioning space; 102 refers to a blower; 103 refers to a desiccant wheel; 104 refers to a sensible heat exchanger; 105 refers to a humidifier; 106 refers to a water supply pipe for the humidifier; 107–111 refer to air passages for conditioned air flows; 130 refers to a blower for the regeneration air; 120 refers to a heat exchanger between hot water and regeneration air (hot water heat exchanger); 121 refers to a sensible heat exchanger; 122, 123 refer to hot water passages; and 124–129 refer to air passages for regeneration air. In FIG. 6, circled letters K–V represent thermodynamic states of the air corresponding to respective sites shown in FIG. 7, SA designates supply air, RA designates return air, OA designates outside air and EX designates exhaust air.

In the above desiccant assisted air conditioning apparatus, after dehumidifying the return air (process air) through moisture adsorption process by flowing it through the desiccant wheel 103, the return air is cooled by heat exchange with the regeneration air, and is supplied to the conditioning space. In the meanwhile, outside air is used as regeneration air, which is heated by a heat transfer medium of an external heat source (not shown) and is introduced to the desiccant wheel 103 for regenerating the desiccant wheel 103. The regeneration air is exhausted to the outside environment. The conditioning space is cooled by repeating the above processes.

One of the alternatives of the above apparatus utilizes exhaust air from the conditioning room as regeneration air and introduces the outer air as a process air.

The energy efficiency of such an air conditioning apparatus is given by a value of coefficient of performance ($COP=\Delta Q/\Delta H$) which is obtained by dividing the enthalpy difference $\Delta Q$ (an indication of cooling effect) shown in FIG. 7 by regeneration heat $\Delta H$ (amount of the regeneration heat). In the conventional desiccant assisted air conditioning apparatus, even though the temperature of the hot water required for heating the regeneration air has been lowered compared with the earlier apparatus, the COP values are still lower than those of air conditioning apparatus which uses other thermally driven refrigeration devices, such as a double effect absorption chiller for cooling and dehumidification of ambient air. The reason is that, though it is based on a high temperature heat source of a boiler, the system only utilizes less than one unit of high quality energy (excergy) out of one unit at temperatures less than 100° C. for the regeneration of the desiccant.

One of the measures to solve the above problem is an air conditioning apparatus, as shown in FIG. 8, in which an absorption heat pump 200, in place of a boiler, is provided as a heat source. The heat recovered from an absorber 1 and a condenser 4 is introduced to the heater 120 through the heat transfer medium passages 123, 42, 43, 122, and the cooling effect generated in the evaporator 3 is introduced into a cooler 115 provided in the process air passage through refrigerant passages 118, 53, 117. According to the air conditioning apparatus, a cooling effect due to a sensible heat exchange between the process air and the regeneration air ($\Delta Q-\Delta q$) can be obtained in addition to the cooling effect ($\Delta q$) of an absorption heat pump 200 so as to realize a higher energy efficiency with a more compact construction of the system than the air conditioning system shown in FIG. 6.

However, in the air conditioning device described above, when an absorption refrigeration cycle of a so-called single effect type is used in the absorption heat pump, and a lithium bromide-water working fluid system is used, if the absorption temperature is set 60–80° C., which is suitable for a heat source of the desiccant assisted air conditioning apparatus, while the evaporation temperature is set 10–15° C., which is suitable for cooling temperature of the process air, then the thermodynamics state of the absorbent fluid compatible with such liquid temperature and evaporation pressure condition exceeds a crystallization limit so as to disable the operation due to crystallization. Also, since the condensation temperature is raised to 60–80° C., the difference between the temperature of the condensed refrigerant and the evaporation temperature (10–15° C.), and, consequently, the difference in enthalpy therebetween are increased. As a result, the cooling efficiency is much lowered compared to ordinary absorption chiller, where condensing temperature is approximately 40° C., due to the self-evaporation of the refrigerant when it is introduced into the evaporator, so that the COP value of the heat pump is deteriorated.

SUMMARY OF THE INVENTION

It is therefore an object of the present invention to achieve a desiccant assisted air conditioning apparatus, which can provide a stable operation and a higher energy efficiency.

According to the invention, a desiccant assisted air conditioning apparatus comprises: a process air passage for flowing process air for dehumidification through a desiccant and for delivery to a conditioning space; a regeneration air passage for flowing regeneration air for removing moisture from the desiccant; and an absorption heat pump means for providing a cooling source for the process air and a heating source for the regeneration air, the absorption heat pump means having an evaporator, an absorber, a generator, a condenser and fluid passages therebetween for forming an absorption refrigeration cycle, wherein the absorption heat pump means is provided with a heat exchanger in a refrigerant passage between the condenser and the evaporator for cooling a refrigerant flowing through the refrigerant passage by heat exchange with a heat transfer medium. According to the invention, by cooling the refrigerant flowing from the condenser to the evaporator by the heat exchanger, the loss portion of the cooling effect due to the self-evaporation of the refrigerant when flowing into the evaporator is decreased so that a large cooling effect is produced. Therefore, the cooling effect of the entire system can be improved to provide a high energy efficiency.

In another aspect of the invention, the heat transfer medium is in a heat exchange relationship with the regeneration air in the regeneration air passage for heating the regeneration air. In this aspect of the invention, the heat transfer medium is provided at its lowest temperature to the heat exchanger, the efficiency for cooling the refrigerant is increased, so that the loss of the cooling efficiency due to the self-evaporation of the refrigerant when flowing into the evaporator is further decreased. In addition, since the heat held by the refrigerant itself cane recovered and utilized for heating the regeneration air, cooling efficiency can be further improved and a high energy efficiency is obtainable.

DESCRIPTION OF THE PREFERRED EMBODIMENTS

Figure 1:
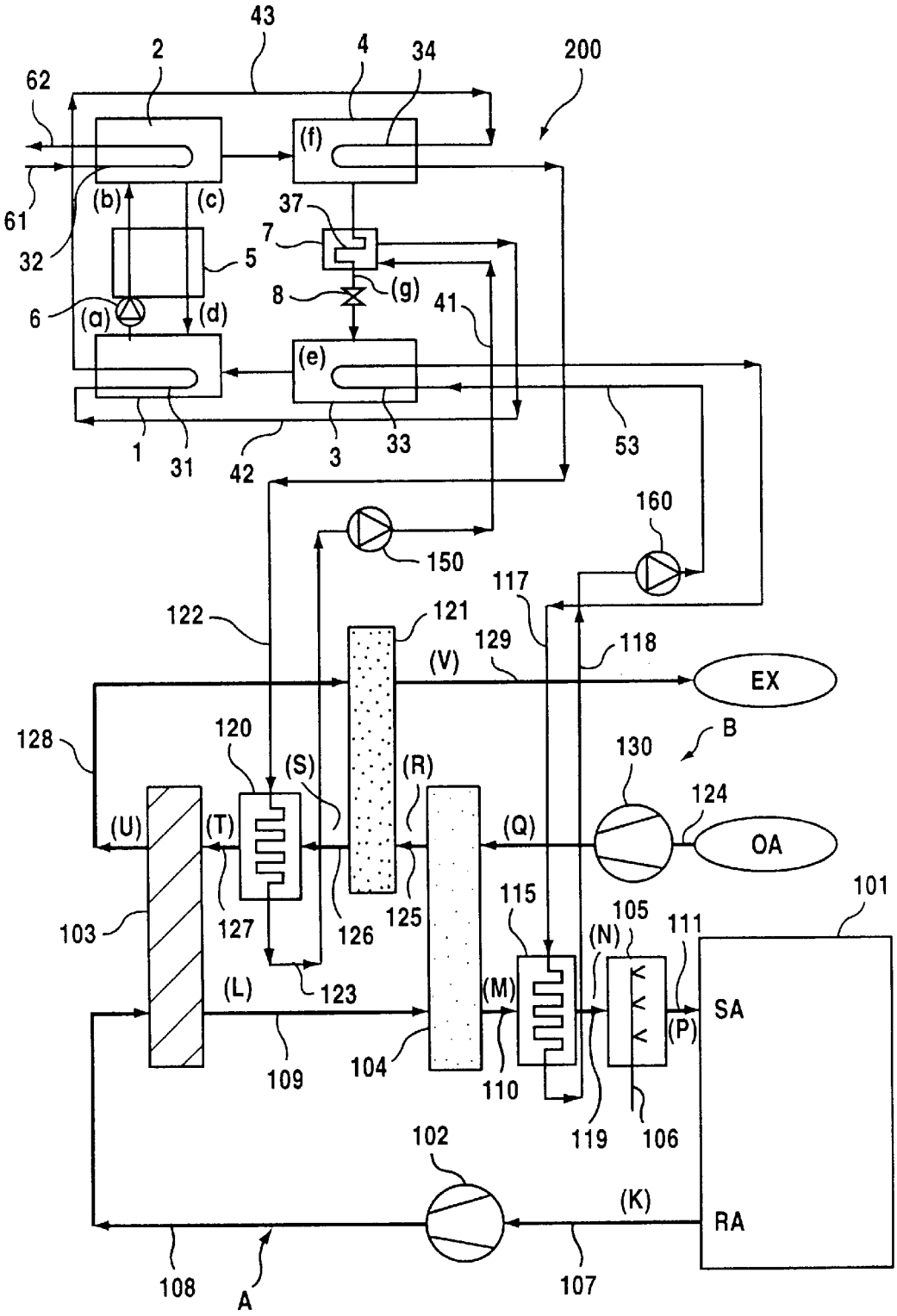
FIG. 1 is a schematic representation of a first embodiment of the desiccant assisted air conditioning apparatus of the present invention.

Hereinafter, preferred embodiments of the present invention will be described in detail. Throughout the specification, the same features are denoted by the same reference numerals.

Figure 2:
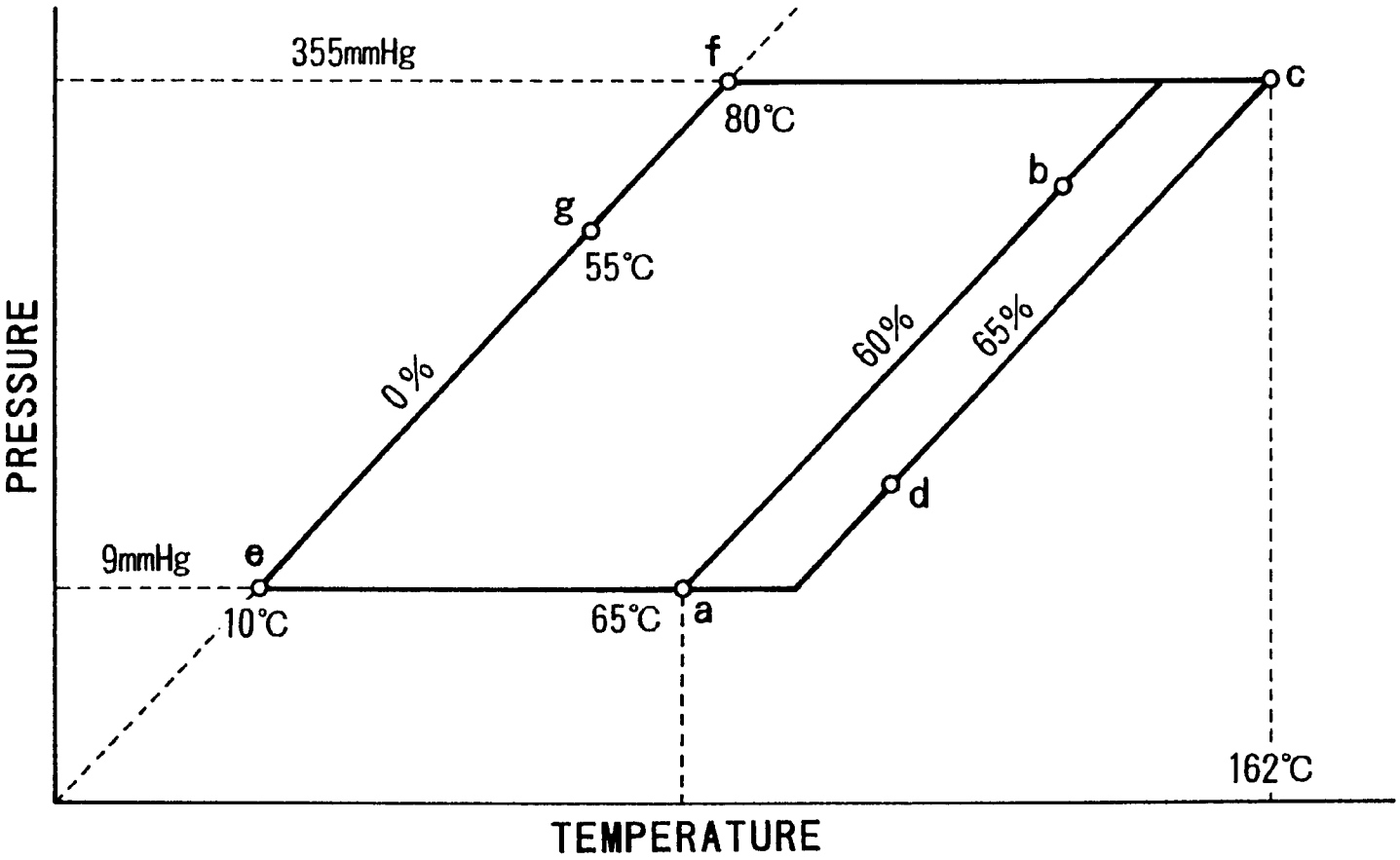
FIG. 2 is a Duhring's diagram showing the operational cycles of the desiccant assisted air conditioning apparatus of the first embodiment.
Figure 3:
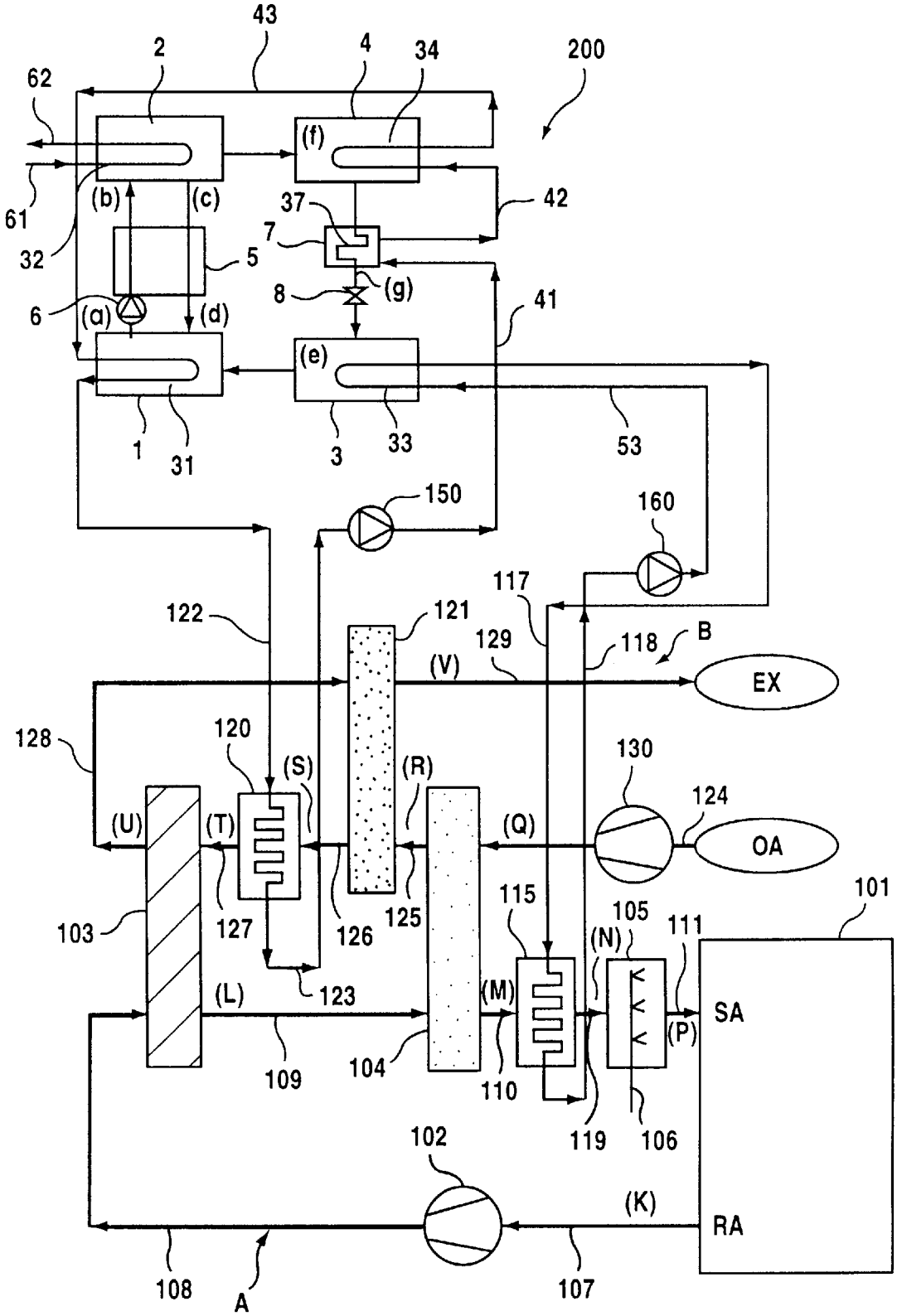
FIG. 3 is a schematic representation of a second embodiment of the desiccant assisted air conditioning apparatus of the present invention.

A first embodiment of the preferred embodiment will be explained below with reference to FIGS. 1 to 3. FIG. 1 is a schematic representation of the basic configuration of the desiccant assisted air conditioning apparatus of the present invention. The heat pump device section of the apparatus comprises a circulation unit to provide an absorption refrigeration cycle including an evaporator 3, an absorber 1, a generator 2, a condenser 4, and a heat exchanger 5. The heat pump device section further includes a heat exchanger 7 provided in a refrigerant passage between the condenser 4 and the evaporator 3 for cooling a refrigerant, and a heat transfer medium (hot water) passage is provided to flow hot water from a heater 120 of the desiccant assisted air conditioning apparatus through a pump 150, the heat exchanger 7, the absorber 1 and condenser 4 to return to the heater 120.

Figure 8:
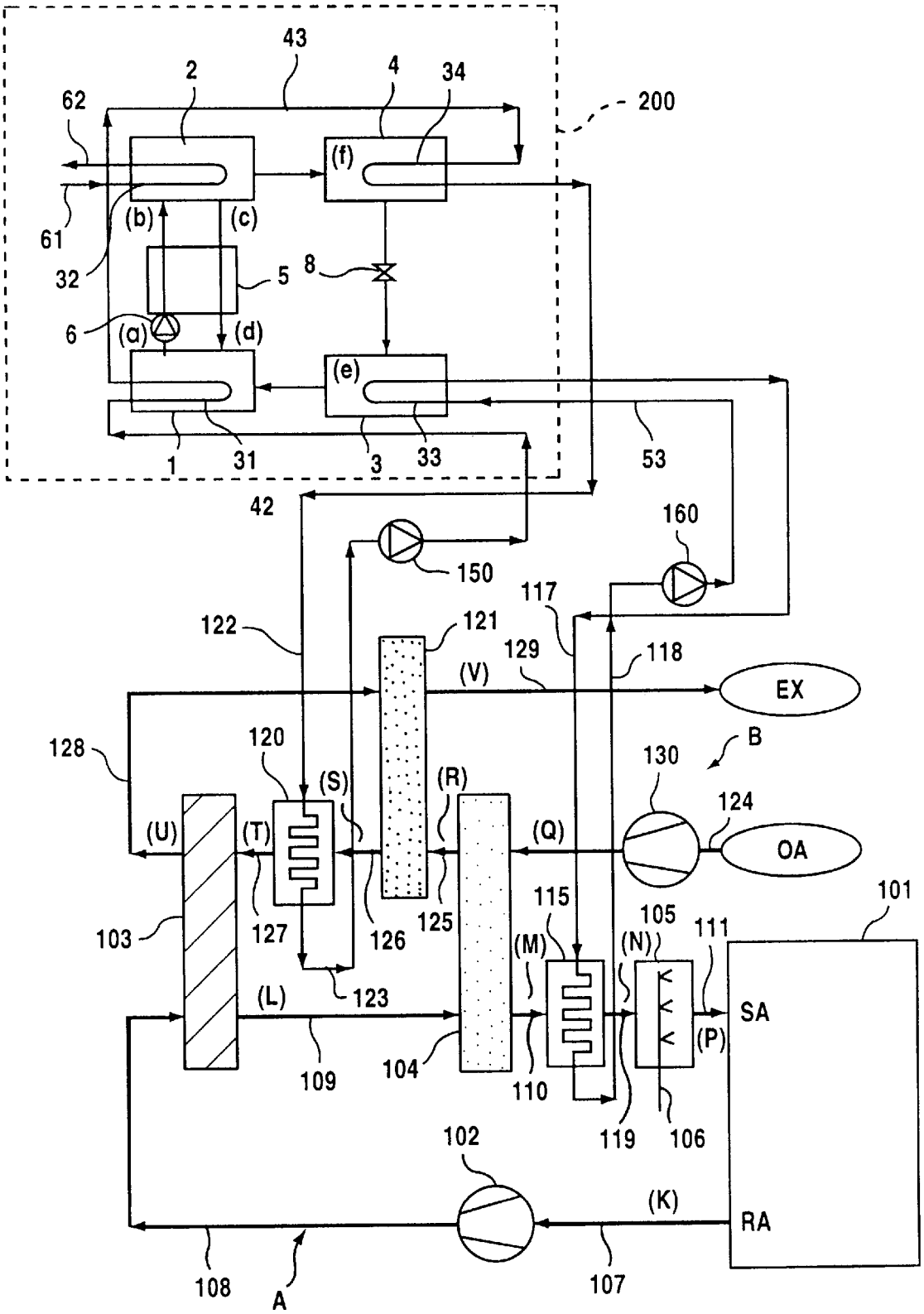
FIG. 8 is a schematic representation of a hypothetical desiccant assisted air conditioning apparatus.

The air conditioning section of the desiccant assisted air conditioning apparatus shown in FIG. 1 is constructed in the same manner with that of FIG. 8. A process air passage A is formed as follows: the conditioning space 101 is communicated with the intake of the blower 102 through the passage 107; the outlet of the blower 102 is communicated with the desiccant wheel 103 through the passage 108; the discharge for the process air from the desiccant wheel 103 is communicated with the sensible heat exchanger 104 which has heat-exchanger relationship with the regeneration air through the passage 109; the outlet for the process air from the heat exchanger 104 is communicated with the chilled water heat exchanger (cooler) 115 through the passage 110; the outlet for the process air from the cooler 115 is communicated with the humidifier 105 through the passage 119; and the outlet for the process air from the humidifier 105 is communicated with the conditioning space 101 through the passage 111; thereby completing a processing cycle for the process air.

In the meanwhile, the regeneration air passage B is formed as follows: the external space is communicated with the intake of the blower 130 through the passage 124; the outlet of the blower 130 is communicated with the sensible heat exchanger 104 heat-exchangeable with the process air; the outlet for the regeneration air from the sensible heat exchanger 104 is communicated with the inlet of the low temperature side of another heat exchanger 121 through a passage 125; the outlet of the low temperature side of the sensible heat exchanger 121 is communicated with the hot water heat exchanger 120 through the passage 126; the outlet for the regeneration air of the hot water heat exchanger 120 is communicated with the inlet of the regeneration air of the desiccant wheel 103 through the passage 127; the outlet for the regeneration air from the desiccant wheel 103 is connected to the inlet of the high temperature side of the sensible heat exchanger 121 through the passage 128; the outlet of the high temperature side of the sensible heat exchanger 121 is communicated with the external space through the passage 129; thereby completing a regeneration cycle for introducing and exhausting the outside air.

The hot water inlet of the heater 120 is communicated with the outlet of the condenser 4 of the absorption heat pump 200 through the passage 122. The hot water outlet of the heater 120 is communicated with the inlet of the heat exchanger 7 in the hot water passage of the absorption heat pump 200 through the passage 123 and the hot water pump 150.

The chilled water inlet of the cooler 115 is communicated with the outlet of the evaporator 3 in the chilled water passage of the absorption heat pump through the passage 117, and the chilled water outlet of the cooler 115 is communicated with the inlet of the evaporator 3 in the chilled water passage of the absorption heat pump through the passage 118 and the pump 160. In FIG. 1, the circled alphabetical designations K–V refer to the thermodynamic states of the air corresponding to those in FIG. 9, and SA designates supply air, RA designates return air, OA designates outside air and EX designates exhaust air.

Next, the absorption cycle of the absorption heat pump section 200 of the desiccant assisted air conditioning system will be explained, referring to the Duhring's diagram of FIG. 2. One of the absorption fluids suitable for the absorption heat pump is the one shown in U.S. Pat. No. 4,614,605 and "Development of an absorption heat pump water heater using aqueous ternary hydroxide working fluid (Int. J. Refrig, 1991 Vol 14, May, p-157), which does not crystallize in the cycle having a high absorption temperature of 60–80° C. at an evaporation temperature of 10–15° C. In this art, the working fluid system is comprised of an aqueous solution including sodium hydroxide, potassium hydroxide or cesium hydroxide as the absorbent, and water as the refrigerant. By such a selection of the working fluids, a refrigeration cycle is formed to provide a stable operation.

The absorbent fluid is heated to 160–165° C. in the generator 2 by an outer heat source (not shown) through heat transfer pipe 32 to generate a refrigerant vapor (state c) and is condensed, and is forwarded to the absorber 1 (state d) through the heat exchanger 5. The absorbent fluid absorbs the refrigerant vapor which was evaporated in the evaporator 3 at 10–15° C. in the absorber 1 and is diluted (state a), and returns to the generator 2 again through the heat exchanger (state b) by the function of the pump 6. As the absorption heat of 67–75° C. generated during the absorption is generated in the absorber 1, it is possible to transfer the absorption heat from the absorbent fluid to the heat transfer medium, such as hot water, through the heat transfer pipe 31. The refrigerant vapor generated in the generator 2 flows into the condenser 4 to be condensed (state f) . In the condenser 4, the condensation heat generated during condensation of the refrigerant vapor is transferred to the hot water through the heat transfer pipe 34. The condensed refrigerant is forwarded to the heat exchanger 7, and an orifice 8 and flows into the evaporator 3 to be evaporated. In the evaporator 3, the evaporation heat of 10–15° C. is transferred from the chilled water by the heat transfer pipe 33. In the heat exchanger 7, the condensed refrigerant of 75–85° C. is cooled by hot water of 50–60° C. (state g) so that the sensible heat of the condensed refrigerant can be recovered by the hot water. And since the enthalpy of the refrigerant at the inlet of the evaporator 3 is reduced, the loss of the cooling effect due to the self-evaporation of the refrigerant flowing into the evaporator 3 is lowered so that high degree of cooling effect can be obtained. Also, the COP value of the heat pump itself is improved, because the required heat input into the heat pump, i.e. heat input to the generator 2, for conducting the required heating of the hot water is reduced.

By flowing the heat transfer medium (hot water) from the heat transfer pipe 31 of the absorber 1 to the heat transfer pipe 34 of the condenser 4, the absorbent fluid temperature becomes lower than the refrigerant condensation temperature, and concentration of the absorbent fluid becomes lower than that when the heat transfer medium flows in adverse. As discussed below, the heat transfer between the air and the hot water is a sensible heat change process of the air in the desiccant assisted air conditioning system, and the specific heat of the air is much lower than that of the water, which means that water is easily changed in temperature. Therefore, by such an arrangement of the heat transfer medium passage described above, it is possible to reduce the hot water flow which may cause a large difference in the temperature of the hot water, thereby reducing the necessary driving power for transporting the heat transfer medium.

Next, the operation of the air conditioning apparatus combining the absorption heat pump device presented above with the desiccant assisted conditioning section will be explained. Referring to FIG. 1, returning air (process air) from the conditioning room 101 is withdrawn through the passage 107 into the blower 102 to be pressurized, and the pressurized air is forwarded to the desiccant wheel 103 through the passage 108, wherein the humidity ratio in the process air is lowered by having the moisture in the process air removed by the moisture adsorbent in the desiccant wheel 103. Heat released during the adsorption process raises the temperature of the process air. The process air with lower humidity and higher temperature is forwarded to the sensible heat exchanger 104 through the passage 109 and cooled by heat exchange with the outside air (regeneration air) . The cooled process air is delivered through the passage 110 to the cooler 115 for further cooling. The cooled process air is delivered to the humidifier 105 for cooling isenthalpically by water spray or evaporative humidification, and the cooled process air is supplied to the conditioning space 101 through the passage 111.

The desiccant material becomes loaded with moisture in the above process, and it is necessary to be regenerated. In this embodiment, this is performed by using the outside air as regeneration air as follows. Outside air (OA) is withdrawn into the blower 130 through the passage 124 to be pressurized, and the pressurized outside air is delivered to the sensible heat exchanger 104 to cool the process air. The regeneration air, having raised its own temperature, is forwarded to the next sensible heat exchanger 121 through the passage 125 wherein heat exchange takes place with the high temperature spent regeneration air to further raise its own temperature, and the regeneration air exiting the sensible heat exchanger 121 flows into the heater 120 through the passage 126. At this point the temperature of the regeneration air is raised to 60–80° C. by the hot water, and its relative humidity is decreased. This process is a sensible heat change process, and the specific heat of the air is much lower than that of the water resulting in a large difference in temperature. Therefore, the heat exchange can be performed efficiently even when the hot water flowrate is reduced causing a large difference in temperature, so that the driving power of the hot water can be reduced. The regeneration air with lower relative humidity exiting the heater 120 is forwarded to the desiccant wheel 103 to remove the moisture for regeneration. After passing through the desiccant wheel 103, the regeneration air flows into the sensible heat exchanger 121 through a passage 128 to preheat the regeneration air, and then is exhausted as waste to the outside through the passage 129.

Figure 9:
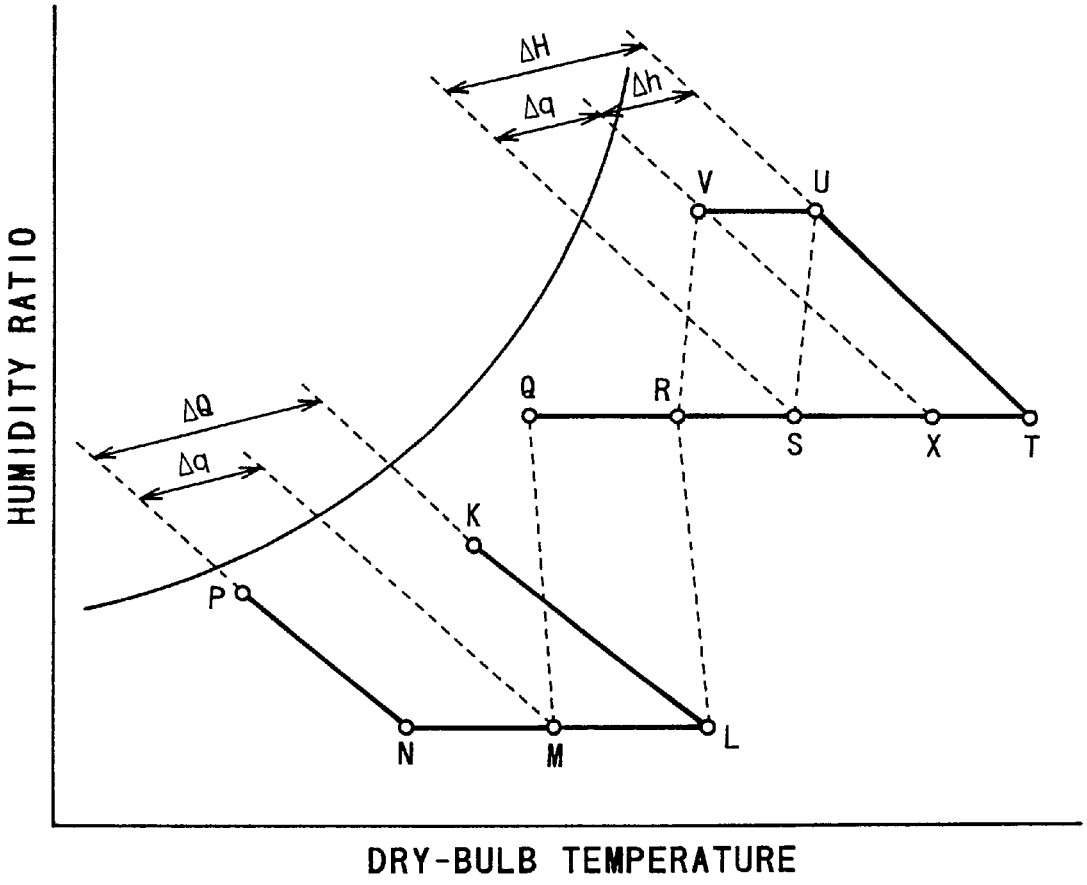
FIG. 9 a psychrometric chart of the conventional desiccant assisted air conditioning apparatus shown in FIG. 8.

The process to this point will be explained with reference to psychrometric chart in FIG. 9. The air to be processed for the conditioning space 101 (process air: state K) is withdrawn through the passage 107 into the blower 102 to be pressurized, and the pressurized process air is forwarded to the desiccant wheel 103 through the passage 108. The humidity ratio in the process air is lowered by being adsorbed of its moisture by the moisture adsorbent in the desiccant wheel 103, and its temperature is raised by absorbing the heat of adsorption (state L) . The process air, having its humidity lowered and temperature raised, is delivered to the sensible heat exchanger 104 through the passage 109, and undergoes heat exchange with outside air (regeneration air) to lower its temperature (state M) . The cooled process air is forwarded to the cooler 115 through the passage 110 to be further cooled (state N). The cooled process air is delivered to the humidifier 105 through the passage 119 and its temperature is lowered isenthalpically by water spray or evaporative humidification (state P), and the process air is supplied to the conditioning space 101 through the passage 111. During the process described above, an enthalpy difference $\Delta Q$ between the return air (state K) and the supply air (state P) is generated to provide the cooling effect to the conditioning space 101. According to the embodiment of FIG. 1, as the enthalpy of the refrigerant at the inlet of the evaporator is lowered and the refrigerating effect of the heat pump is increased, the enthalpy difference ($\Delta q$) becomes larger than that of the conventional art of FIG. 8 and thus the enthalpy difference ($\Delta Q$), which shows the refrigerating effect, becomes larger.

Regeneration of the desiccant is conducted through the following steps. Outside air (OA: state Q) for regeneration is withdrawn into the blower 130 through the passage 124 to be pressurized, and is delivered to the sensible heat exchanger 104 to cool the process air while raising its own temperature (state R), and flows into the next sensible heat exchanger 121 through the passage 125, and, in exchanging heat with the high temperature spent air, raises its own temperature (state S). Regeneration air leaving the heat exchanger 121 flows into the heater 120 through the passage 126 so that its temperature is raised to 60~80° C., and its relative humidity is decreased (state T). Regeneration air having lower relative humidity passes through the desiccant wheel 103 to remove the moisture therefrom (state U). Spent air having passed through the desiccant wheel 103 flows into the sensible heat exchanger 121 through the passage 128, and preheats regeneration air exiting from the sensible heat exchanger 104, and lowers its own temperature (state V) . Spent air is exhausted to outside environment through the passage 129. The process cycles described above, i.e., regeneration of desiccant on the one hand and dehumidification and cooling of process air on the other, is repeatedly carried out to provide desiccant assisted air conditioning of the conditioning space. It is a common practice to utilize exhaust air from the conditioning room as regeneration air, and in this invention also, there is no problem in utilizing the exhaust room air for regeneration air, and the same result will be obtained. In this embodiment, the heat transfer medium is introduced to the heat exchanger 7 to exchange heat with the refrigerant. However, the heat may be radiated to the outer space to lower the enthalpy of the refrigerant.

According to the first embodiment of the present invention, since the heat exchanger 7 is provided in the refrigerant passage from the condenser to the evaporator, loss of the cooling efficiency due to the self-evaporation of the refrigerant is lowered, and thus high degree of refrigeration effect is obtained. Further, the heat held in the condensed refrigerant, the absorption heat and the condensation heat can be used as a heat source for heating the regeneration air. Accordingly, due to the increased cooling performance and improved COP value of the heat pump, the energy efficiency of the entire air conditioning system can be improved.

Next, a second embodiment of the preferred embodiment will be explained below with reference to FIG. 3. According to the second embodiment of the present invention, a heat exchanger 7 for cooling the refrigerant is provided in the refrigerant passage from the condenser 4 to the evaporator 3 so that the hot water from the heater 120 passes the pump 150, the heat exchanger 7, the condenser 4 and absorber 1, and then returns to the heater 120. According to this embodiment, the heat transfer medium at its lowest temperature, likewise the first embodiment, is first introduced into the heat exchanger 7 for cooling the refrigerant through heat exchange therewith, and then is introduced to the absorber 1 and the condenser 4 to be heated. Accordingly, the efficiency for cooling the refrigerant is increased, and the loss of the cooling efficiency due to the self-evaporation of the refrigerant when flowing into the evaporator is decreased. Therefore, the cooling effect of the entire system can be improved. In addition, energy held by the refrigerant can be recovered and utilized for heating the regeneration air, so that cooling efficiency can further be improved and high energy efficiency can be provided. In this embodiment, when the heat transfer medium flows from the heat transfer pipe 34 of the condenser 4 to the heat transfer pipe 31 of the absorber 1, the absorbing liquid temperature becomes higher than the refrigerant condensation temperature, resulting in a higher concentration of the refrigerant in the absorbent fluid than that when the heat transfer medium flows in adverse. However, there is not any problem in a practical operation because the higher concentration of the refrigerant does not result in a crystallization. Moreover, since the condenser 4 and the heat exchanger 7 are communicated through both the refrigerant passage and the hot water passage, the condenser 4 and the heat exchanger 7 can be made integrated to reduce the production cost. Since the operation of the absorption heat pump and the desiccant assisted air conditioning system is substantially the same as that of the first embodiment, detailed description thereof will be omitted.

Figure 4:
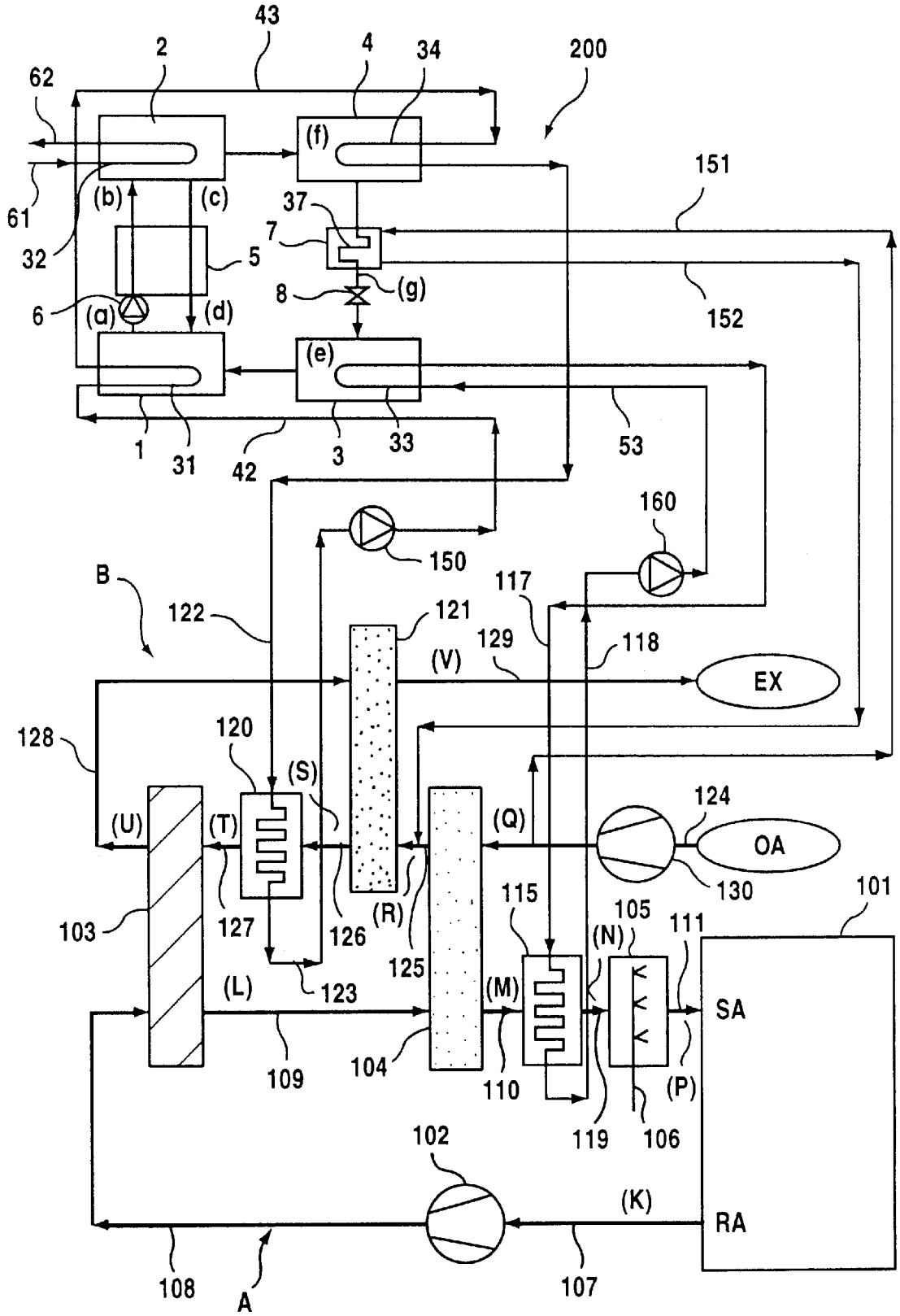
FIG. 4 is a schematic representation of a third embodiment of the desiccant assisted air conditioning apparatus of the present invention.

Next, a third embodiment of the preferred embodiment will be explained below with reference to FIG. 4. According to the third embodiment of the present invention, a heat exchanger 7 for cooling the refrigerant is provided in the refrigerant passage from the condenser 4 of the absorption heat pump 200 to the evaporator 1. In this embodiment, the regeneration air is branched off from the regeneration air passage B at the point downstream the blower 130 and the upstream the sensible heat exchanger 104 so that a part of the regeneration air is introduced to the heat exchanger 7 through a branch passage 151, and the heat-exchanged air returns to the main passage 125 through a branch passage 152. According to this embodiment, the refrigerant is cooled by the fresh regeneration air introduced from outside and at its lowest temperature, the efficiency for cooling the refrigerant is increased, so that the loss of the cooling efficiency due to the self-evaporation of the refrigerant when flowing into the evaporator 3 is decreased. Therefore, the cooling effect of the entire system can be improved. In addition, since the heat held by the refrigerant itself can be recovered and utilized for heating the regeneration air, refrigerating efficiency can be further improved and high energy efficiency is obtainable. Since the operation of the absorption heat pump and the desiccant assisted air conditioning system is substantially the same as that of the first embodiment, detailed description thereof will be omitted. In this embodiment, some intermediate heat transfer medium such as water heat-exchangeable with the regeneration air can be used for cooling the refrigerant in the heat exchanger 7, instead of using the regeneration air directly.

Figure 5:
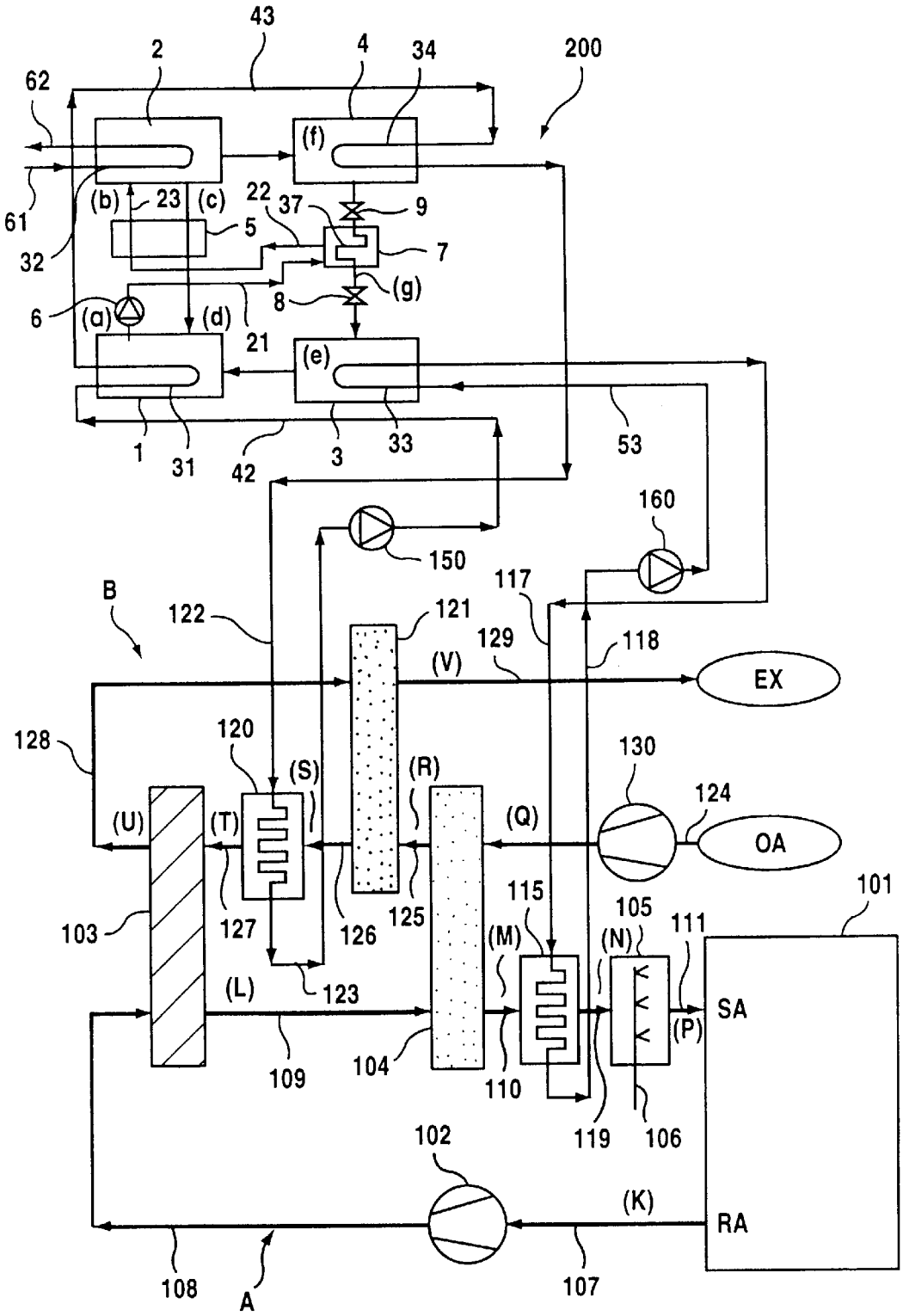
FIG. 5 is a schematic representation of a fourth embodiment of the desiccant assisted air conditioning apparatus of the present invention.
Figure 6:
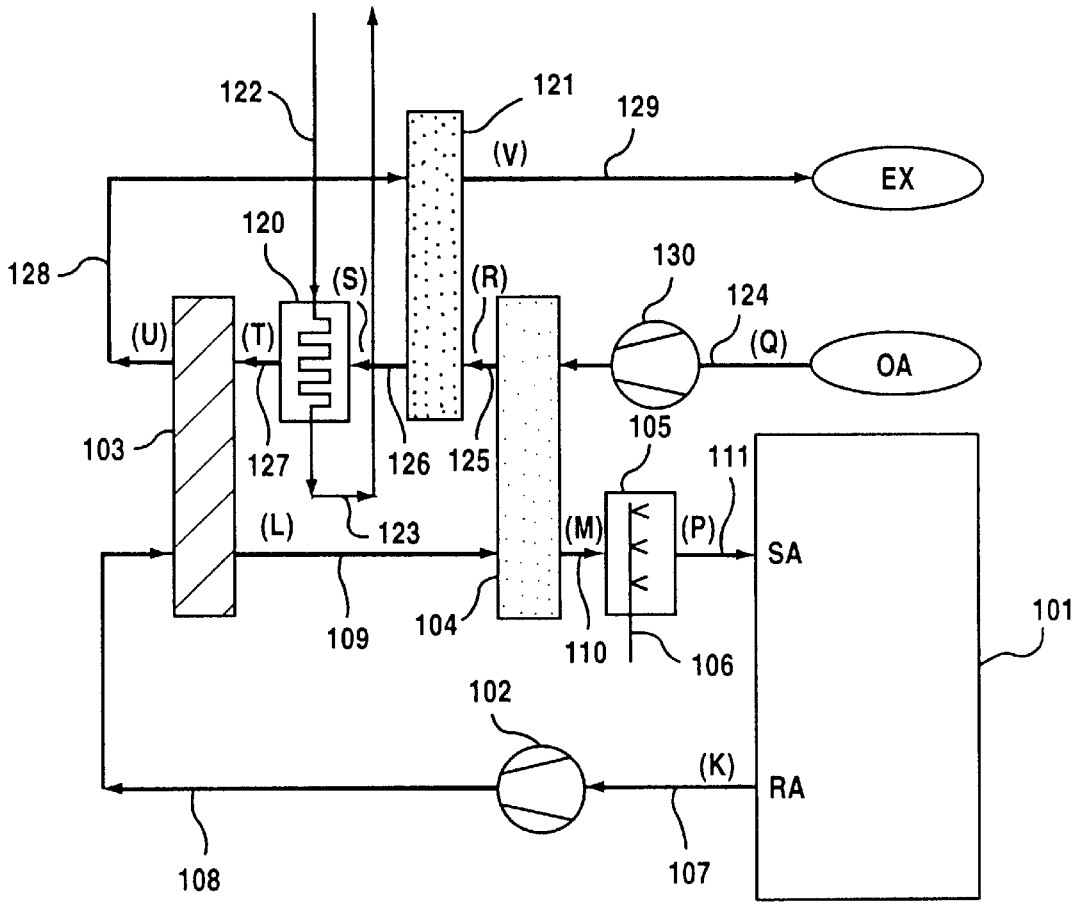
FIG. 6 is a schematic representation of a conventional desiccant assisted air conditioning apparatus.
Figure 7:
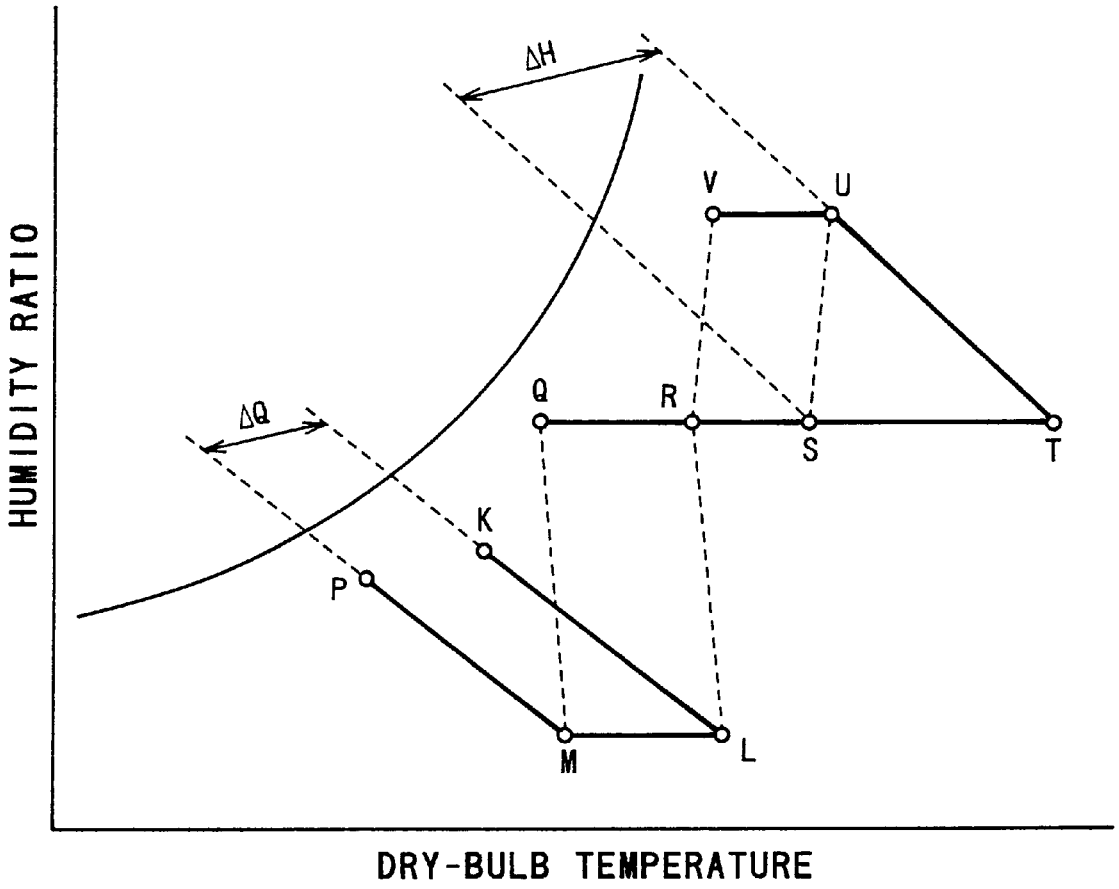
FIG. 7 is a psychrometric chart of the desiccant assisted air conditioning apparatus shown in FIG. 6.

Next, a fourth embodiment of the preferred embodiment will be explained below with reference to FIG. 5. According to the embodiment, a heat exchanger 7 for cooling the refrigerant is also provided in the refrigerant passage from the condenser 4 to the evaporator 3 in the absorption heat pump 200. In this embodiment, a heat transfer passage 21 is provided to introduce the absorbent fluid exiting the absorber 1 to the heat exchanger 7 to exchange heat with the refrigerant flowing from the condenser 4 to the evaporator 3, the absorbent fluid after heat exchange is then introduced to the heat exchanger 5 and to the generator 2. According to this embodiment, since the absorbent fluid at its lowest temperature is introduced to the heat exchanger 7 to cool the refrigerant, the efficiency for cooling the refrigerant is increased, and the loss of the cooling efficiency due to the self-evaporation of the refrigerant when flowing into the evaporator 3 is decreased. Therefore, the cooling effect of the entire system can be improved. In addition, since the heat of the condensed refrigerant is recovered into the absorbent fluid system, the required heat input into the heat pump, i.e. heat input to the generator 2, for conducting the required heating of the hot water is reduced so as to provide an improved COP value of the heat pump as well as a high energy efficiency. Since the operation of the absorption heat pump and the desiccant assisted air conditioning system is substantially the same as that of the first embodiment, detailed description thereof will be omitted.

Although the foregoing embodiments were illustrated in terms of understanding, and should not be construed to limit the scope of the present invention.

What is claimed is:

1. A desiccant assisted air conditioning apparatus comprising:

a process air passage flowing process air for dehumidification through a desiccant and for delivery to a conditioning space;

a regeneration air passage flowing regeneration air for removing moisture from said desiccant; and an absorption heat pump means providing a cooling source for said process air and a heating source for said regeneration air, said absorption heat pump means having an evaporator, an absorber, a generator, a condenser and fluid passages therebetween forming an absorption refrigeration cycle, wherein said absorption heat pump means includes a heat exchanger disposed in a refrigerant passage between said condenser and said evaporator, and flow passage means operative to conduct a heat transfer medium between said heat exchanger for cooling a refrigerant flowing through said refrigerant passage and said air conditioning apparatus for removing moisture from said desiccant.

2. A desiccant assisted air conditioning apparatus according to claim 1, wherein said heat transfer medium is in a heat exchange relationship with said regeneration air in said regeneration air passage for heating said regeneration air.

3. A desiccant assisted air conditioning apparatus according to claim 1, wherein said heat transfer medium comprises at least a portion of said regeneration air in said regeneration air passage.

4. A desiccant assisted air conditioning apparatus according to claim 1, wherein said heat transfer medium is introduced to said absorber and said condenser so as to be heated therein after exiting said heat exchanger.

5. A desiccant assisted air conditioning apparatus comprising:

a process air passage flowing process air for dehumidification through a desiccant and for delivery to a conditioning space;

a regeneration air passage flowing regeneration air for removing moisture from said desiccant, an absorption heat pump means providing a cooling source for said process air and a heating source for said regeneration air, said absorption heat pump means having an evaporator, an absorber, a generator, a condenser and fluid passages therebetween forming an absorption refrigeration cycle, wherein said absorption heat pump means is provided with a heat exchanger disposed in a refrigerant passage between said condenser and said evaporator for cooling a refrigerant flowing through said refrigerant passage by heat exchange with a heat transfer medium, and wherein said heat transfer medium comprises an absorbent fluid exiting said absorber.

6. A desiccant assisted air conditioning apparatus according to claim 1, wherein an absorbent fluid in said absorption heat pump means is an aqueous solution comprising at least of one selected from the group consisting of sodium hydroxide, potassium hydroxide and cesium hydroxide, and the refrigerant is water.

7. A desiccant assisted air conditioning apparatus comprising:

a process air passage for flowing process air for dehumidification through a desiccant and for delivery to a conditioning space;

a regeneration air passage for flowing regeneration air for removing moisture from said desiccant; and and absorption heat pump means for providing a cooling source for said process air and a heating source for said regeneration air, said absorption heat pump means having an evaporator, an absorber, a generator, a condenser and fluid passages therebetween forming an absorption refrigeration cycle, wherein said absorption heat pump means is provided with a heat exchanger for exchanging heat between a refrigerant flowing between said condenser and said evaporator and an absorbent liquid exiting said absorber for cooling said refrigerant.

8. A desiccant assisted air conditioning apparatus according to claim 5, wherein an absorbent fluid in said absorption heat pump means is an aqueous solution comprising at least one selected from the group consisting of sodium hydroxide, potassium hydroxide and cesium hydroxide, and the refrigerant is water.

* * * * *